US006736045B2

(12) United States Patent
Chang

(10) Patent No.: US 6,736,045 B2
(45) Date of Patent: May 18, 2004

(54) MANUALLY OPERATED CORNER CUTTER

(76) Inventor: Chun-Yuan Chang, 58, Ma Yuan West St., Taichung (TW)

( * ) Notice: Subject to any disclaimer, the term of this patent is extended or adjusted under 35 U.S.C. 154(b) by 51 days.

(21) Appl. No.: 10/176,842

(22) Filed: Jun. 18, 2002

(65) Prior Publication Data

US 2003/0229991 A1 Dec. 18, 2003

(51) Int. Cl.[7] ..... B26F 1/02

(52) U.S. Cl. ..... 83/549; 83/633; 83/686; 83/690

(58) Field of Search ..... 83/633, 686, 687, 83/690, 634, 692, 636, 955, 549, 552, 453

(56) References Cited

U.S. PATENT DOCUMENTS 1,335,632 A * 3/1920 Zimmer ..... 83/513
1,669,344 A * 5/1928 Moore ..... 83/560
4,404,881 A * 9/1983 Hanifl ..... 83/167
5,178,049 A * 1/1993 Tsai-Hsin ..... 83/164
6,089,137 A * 7/2000 Lee ..... 83/621
6,289,709 B1 * 9/2001 Geurts ..... 72/327

* cited by examiner

*Primary Examiner*—Kenneth E. Peterson
*Assistant Examiner*—Omar Flores-Sánchez

(57) ABSTRACT

A manually operated corner cutter includes a base, a support and guide device, a blade post, multiple cutting tools, a press and control handle, and a press plate. The support and guide device includes an upright support post and a slide seat each secured on the base. Thus, the manually operated corner cutter may be operated easily, rapidly and conveniently. In addition, the cutting tool may be replaced easily and conveniently, thereby facilitating replacement of the cutting tool.

11 Claims, 4 Drawing Sheets

F I G. 2

MANUALLY OPERATED CORNER CUTTER

BACKGROUND OF THE INVENTION

1. Field of the Invention

The present invention relates to a manually operated corner cutter, and more particularly to a manually operated corner cutter that may be operated easily, rapidly and conveniently.

2. Description of the Related Art

In general, the paper, the name card, the photograph or the like, has sharp corners, thereby easily hurting the human body unintentionally. Thus, the sharp corners may be properly cut or trimmed by a cutting tool, such as the scissors or the like, so as to form an arcuate configuration, thereby preventing from hurting the human body unintentionally. However, the scissors cannot cut the sharp corners in a regular manner, thereby easily affecting the outstanding appearance of the paper, the name card, the photograph or the like.

SUMMARY OF THE INVENTION

The primary objective of the present invention is to provide a manually operated corner cutter that may be operated easily, rapidly and conveniently.

Another objective of the present invention is to provide a manually operated corner cutter, wherein the cutting tool may be replaced easily and conveniently, thereby facilitating replacement of the cutting tool.

A further objective of the present invention is to provide a manually operated corner cutter has a simple construction, thereby decreasing the cost of fabrication.

In accordance with the present invention, there is provided a manually operated corner cutter, comprising a base, a support and guide device, a blade post, multiple cutting tools, a press and control handle, and a press plate, wherein:

the base has a rear section provided with two opposite vertically arranged stop plates, and a chopping board located between the two opposite stop plates;

the support and guide device includes an upright support post and a slide seat each secured on the base, the slide seat has a front side provided with two opposite lugs and formed with a guide channel located between the two opposite lugs;

the blade post is slidably mounted in the slide seat and has an upper section slidably mounted in the guide channel of the slide seat, and a lower section extended outward from a bottom of the guide channel of the slide seat, a spring is mounted on the lower section of the blade post, and is biased between the upper section of the blade post and the bottom of the guide channel of the slide seat, thereby providing an upward restoring force on the blade post, a blade seat is secured on the lower section of the blade post to move therewith;

each of the multiple cutting tools is secured on the blade seat to move therewith, and has a bottom provided with a cutting blade;

the press and control handle includes two opposite links, and a handgrip mounted between the two opposite links, each of the two opposite links of the press and control handle has a first end secured on one of two ends of the handgrip of the press and control handle, and has a second end pivotally mounted on an upper end of the upright support post, each of the two opposite links of the press and control handle has an intermediate portion pivotally mounted on an upper end of the blade post; and the press plate has multiple corners each formed with a cutting edge of a different type so as to fit the different kinds of cutting blades of the cutting tools, so that the paper may be cut into different kinds of corners.

Further benefits and advantages of the present invention will become apparent after a careful reading of the detailed description with appropriate reference to the accompanying drawings.

DETAILED DESCRIPTION OF THE INVENTION

Figure 1:
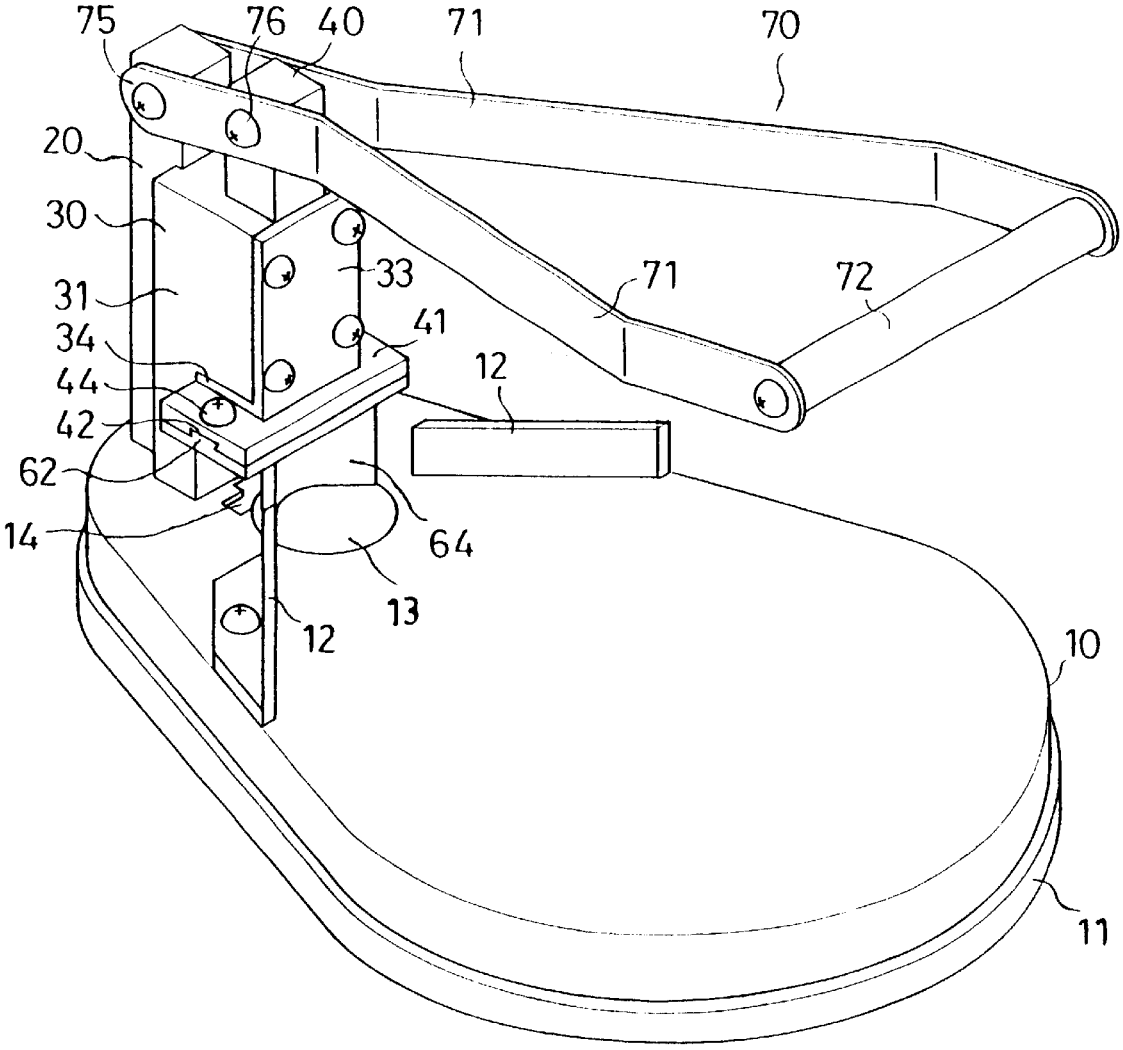
FIG. 1 is a perspective view of a manually operated corner cutter in accordance with a preferred embodiment of the present invention.
Figure 2:
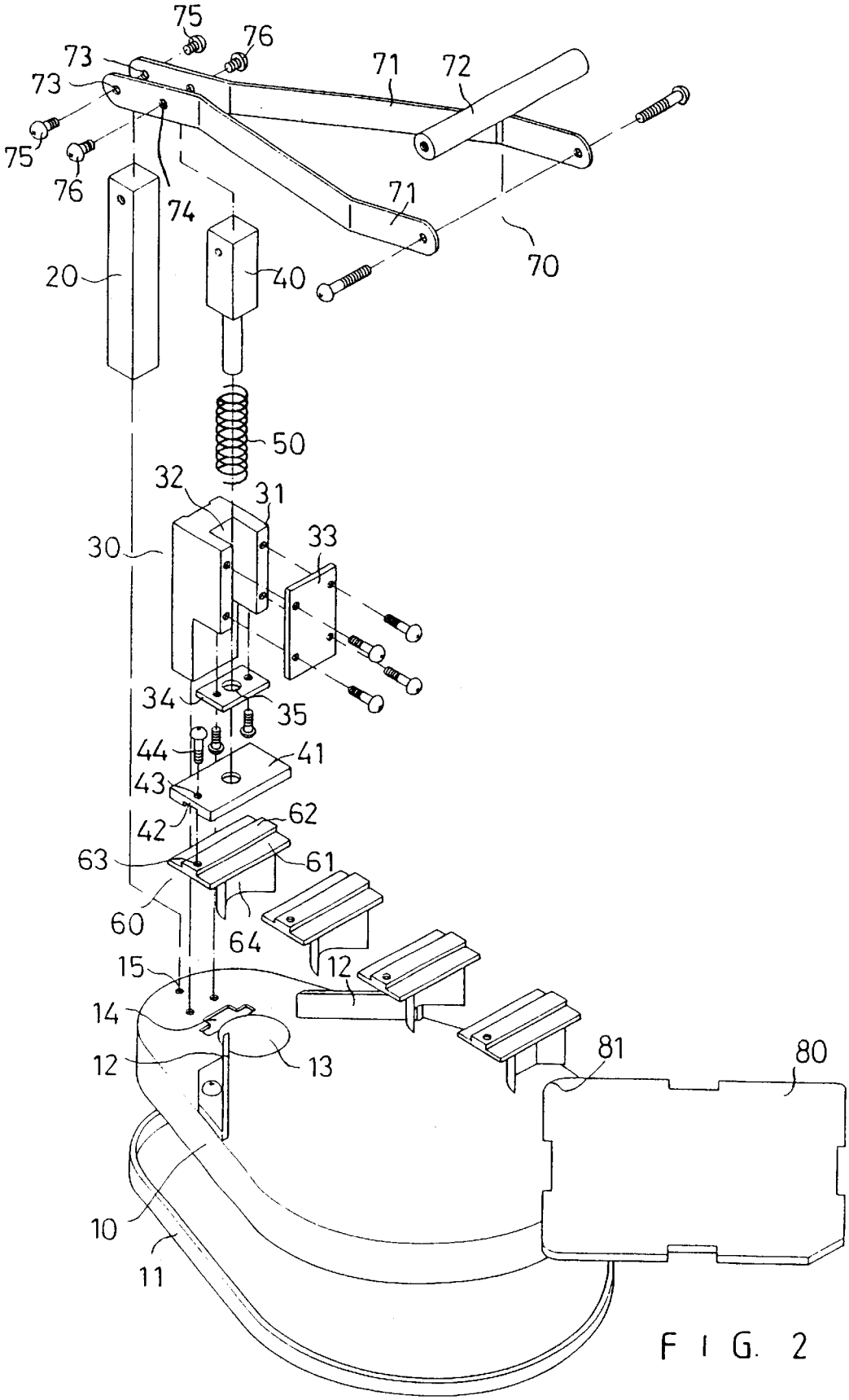
FIG. 2 is an exploded perspective assembly view of the manually operated corner cutter in accordance with the preferred embodiment of the present invention.
Figure 3:
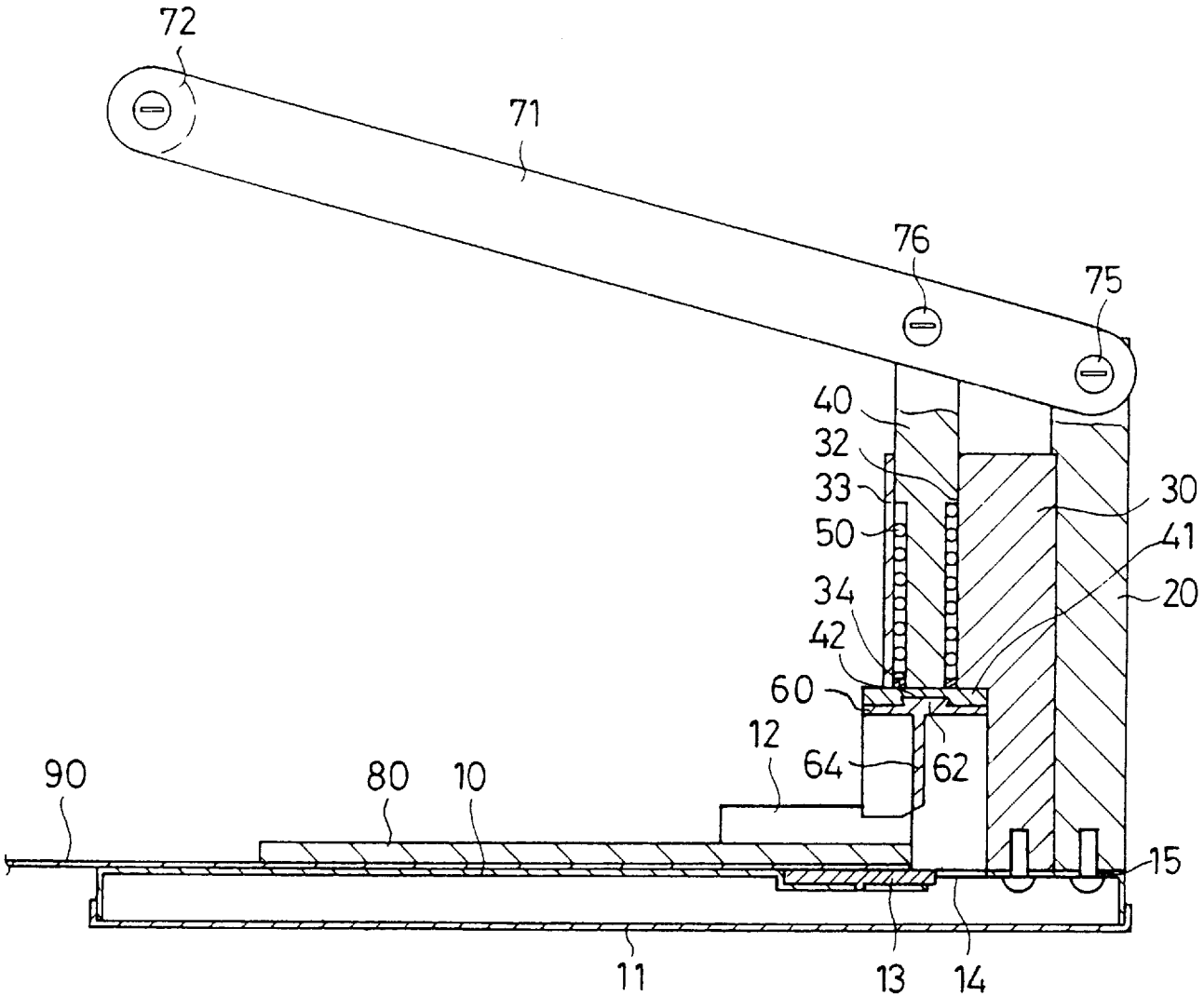
FIG. 3 is a side plan cross-sectional view of the manually operated corner cutter as shown in FIG. 1.

Referring to the drawings and initially to FIGS. 1–3, a manually operated corner cutter in accordance with a preferred embodiment of the present invention comprises a base 10, a support and guide device including an upright support post 20 and a slide seat 30, a blade post 40, multiple cutting tools 60, a press and control handle 70, and a press plate 80.

The base 10 is hollow, and may be combined with a cover 11, thereby forming a receiving space for collecting the cut paper chips. The base 10 has a rear section provided with two opposite vertically arranged stop plates 12, and a chopping board 13 located between the two opposite stop plates 12. The base 10 is formed with a collecting opening 14 located beside the chopping board 13 for introducing the cut paper chips into the receiving space between the base 10 and the cover 11. The base 10 is formed with multiple bolt holes 15 located beside the collecting opening 14 for locking the upright support post 20 and the slide seat 30 of the support and guide device.

The support and guide device includes the upright support post 20 and the slide seat 30 which may be combined with each other and may be integrally formed with each other. The slide seat 30 has a height slightly smaller than that of the upright support post 20. The slide seat 30 has a front side provided with two opposite lugs 31 and formed with a guide channel 32 located between the two opposite lugs 31. A front sealing plate 33 is secured on the two opposite lugs 31 of the slide seat 30 to seal the front side of the guide channel 32, and a lower sealing plate 34 is secured on the two opposite lugs 31 of the slide seat 30 to seal the bottom side of the guide channel 32, thereby forming a semi-sealed guide space. The lower sealing plate 34 is formed with a through hole 35.

The blade post 40 is slidably mounted in the slide seat 30 and has a square upper section slidably mounted in the guide channel 32 of the slide seat 30, and a circular lower section extended outward from the through hole 35 of the lower sealing plate 34. A spring 50 is mounted on the lower section of the blade post 40, and is biased between the upper section of the blade post 40 and the lower sealing plate 34, thereby providing an upward restoring force on the blade post 40. A blade seat 41 is secured on the lower section of the blade post 40 to move therewith. The blade seat 41 has a bottom longitudinally formed with a dovetail shaped insertion groove 42. The blade seat 41 has one side formed with a bolt hole 43.

Each of the multiple cutting tools 60 has a top face provided with a dovetail shaped insertion block 62 that may be inserted into the dovetail shaped insertion groove 42 of the blade seat 41. Each of the multiple cutting tools 60 has one side formed with a bolt hole 63 aligning with the bolt hole 43 of the blade seat 41. A bolt 44 is extended through the bolt hole 43 of the blade seat 41, and is screwed into the bolt hole 63 of one of the multiple cutting tools 60, for combining the blade seat 41 with one of the multiple cutting tools 60. Each of the multiple cutting tools 60 has a bottom provided with a cutting blade 64. The cutting blades 64 of the multiple cutting tools 60 have different types, so that the multiple cutting tools 60 having different types may be used to cut corners of different types.

The press and control handle 70 includes two opposite links 71, and a handgrip 72 mounted between the two opposite links 71. Each of the two opposite links 71 of the press and control handle 70 has a first end secured on one of two ends of the handgrip 72 of the press and control handle 70, and has a second end pivotally mounted on an upper end of the upright support post 20. The second end of each of the two opposite links 71 of the press and control handle 70 is formed with a bolt hole 73 for passage of a bolt 75 which is screwed into the upper end of the upright support post 20, so that the second end of each of the two opposite links 71 of the press and control handle 70 is pivotally mounted on the upper end of the upright support post 20. Each of the two opposite links 71 of the press and control handle 70 has an intermediate portion pivotally mounted on an upper end of the blade post 40. The intermediate portion of each of the two opposite links 71 of the press and control handle 70 is formed with a bolt hole 74 for passage of a bolt 76 which is screwed into the upper end of the blade post 40, so that the intermediate portion of each of the two opposite links 71 of the press and control handle 70 is pivotally mounted on the upper end of the blade post 40.

Thus, the press and control handle 70 may be pivoted about the upright support post 20 to lift or lower the blade post 40, so that the blade post 40, the blade seat 41 and the cutting tool 60 may be pressed by the press and control handle 70 to move downward to proceed the cutting work.

The press plate 80 is a rectangular plate, and has four corners each formed with a cutting edge 81 of a different type so as to fit the different kinds of cutting blades 64 of the cutting tools 60, so that the paper may be cut into different kinds of corners.

Accordingly, in the manually operated corner cutter in accordance with the preferred embodiment of the present invention, the upright support post 20 and the slide seat 30 may be combined to form the support and guide device, for guiding the lifting and lowering movement of the blade post 40, so that the manually operated corner cutter may achieve the corner cutting effect by a simple structure, thereby greatly decreasing the cost of fabrication. In addition, the cutting tool 60 may be mounted on and detached from the blade seat 41 easily and conveniently.

Figure 4:
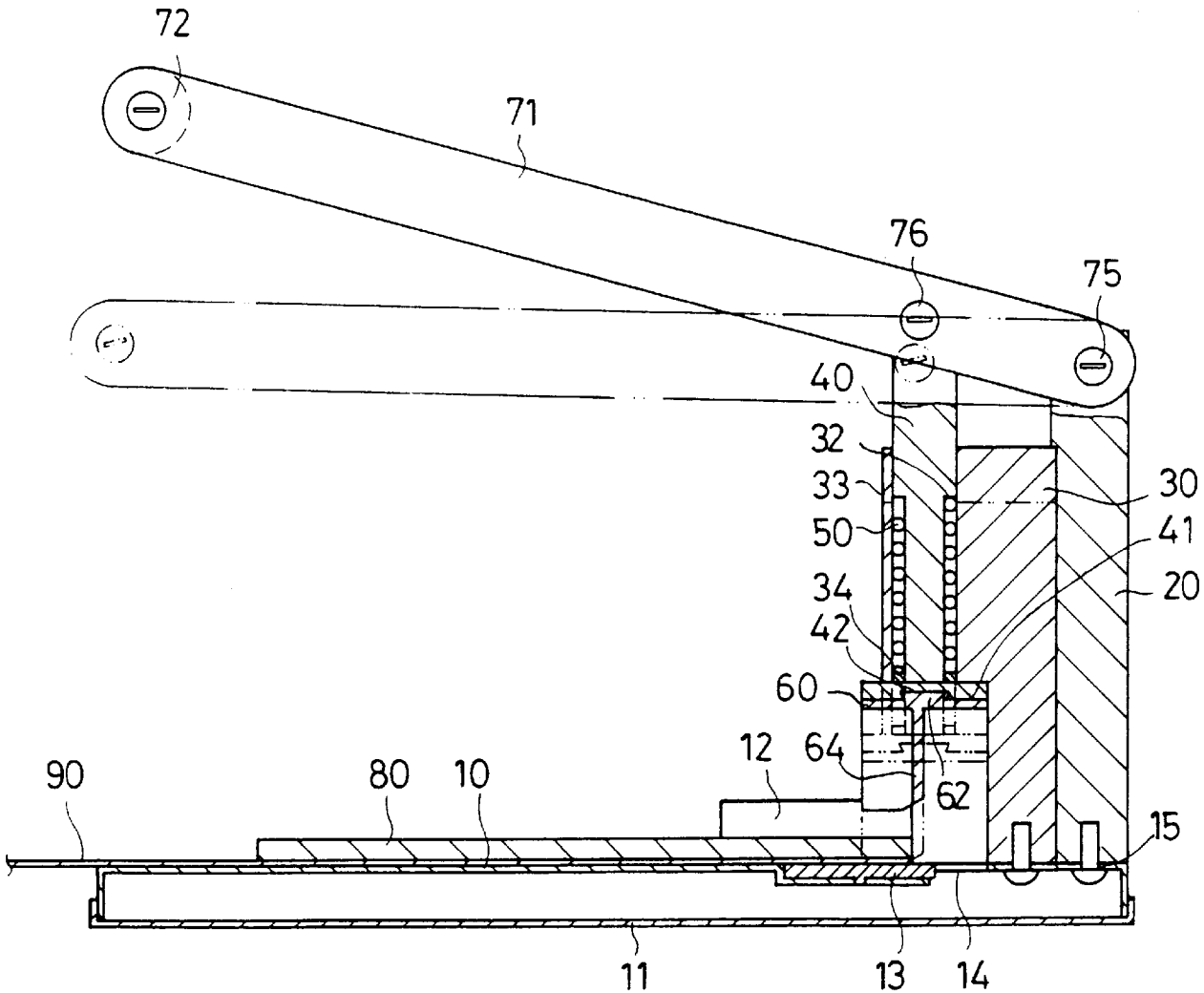
FIG. 4 is a schematic operational view of the manually operated corner cutter as shown in FIG. 3 in use.

In operation, referring to FIGS. 3 and 4 with reference to FIGS. 1 and 2, the paper 90 may be placed on the base 10 and located above the chopping board 13, with two sides of the paper 90 being rested on the two opposite stop plates 12. Then, the press plate 80 may be pressed on the top of the paper 90, with the cutting edge 81 of the press plate 80 aligning with the corner of the paper 90. Then, the press and control handle 70 may be pivoted about the upright support post 20 to press the blade post 40 downward, so that the blade post 40, the blade seat 41 and the cutting tool 60 may be pressed by the press and control handle 70 to move downward to cut the corner of the paper 90 into a predetermined pattern by co-operation of the cutting tool 60 and the press plate 80. Then, the cut paper chips may be introduced into the receiving space between the base 10 and the cover 11 through the collecting opening 14.

In replacement of the cutting tool 60, the bolt 44 may be unscrewed from the bolt hole 63 of one of the multiple cutting tools 60, so that the dovetail shaped insertion block 62 of the cutting tool 60 may be detached from the dovetail shaped insertion groove 42 of the blade seat 41. Then, the dovetail shaped insertion block 62 of another cutting tool 60 may be inserted into the dovetail shaped insertion groove 42 of the blade seat 41, and the bolt 44 may be extended through the bolt hole 43 of the blade seat 41, and screwed into the bolt hole 63 of the cutting tool 60, for combining the blade seat 41 with the cutting tool 60. Thus, the cutting tool 60 may be replaced easily and conveniently, thereby facilitating replacement of the cutting tool 60.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A manually operated corner cutter kit comprising a base, a support and guide device, a blade post, multiple interchangeable cutting tools, a press and control handle, and a press plate, wherein:

the base has a rear section provided with two opposite vertically arranged stop plates, and a chopping board located between the two opposite stop plates;

the support and guide device includes an upright support post and a slide seat each secured on the base, the slide seat has a front side provided with two opposite lugs and formed with a guide channel located between the two opposite lugs;

the blade post is slidably mounted in the slide seat and has an upper section slidably mounted in the guide channel of the slide seat, and a lower section extended outward from a bottom of the guide channel of the slide seat, a spring is mounted on the lower section of the blade post, and is biased between the upper section of the blade post and the bottom of the guide channel of the slide seat, thereby providing an upward restoring force on the blade post, a blade seat is secured on the lower section of the blade post to move therewith;

each of the multiple interchangeable cutting tools is securable on the blade seat to move therewith, and has a bottom provided with a unique cutting blade;

the press and control handle includes two opposite links, and a handgrip mounted between the two opposite links, each of the two opposite links of the press and control handle has a first end secured on one of two ends of the handgrip of the press and control handle, and has a second end pivotally mounted on an upper end of the upright support post, each of the two opposite links of the press and control handle has an intermediate portion pivotally mounted on an upper end of the blade post; and the press plate is pressed on a top of a paper and has multiple corners each formed with a cutting edge of a different type so as to fit the different kinds of cutting blades of the cutting tools, so that the paper may be cut into different kinds of corners.

2. The manually operated corner cutter in accordance with claim 1, wherein the base is hollow, and may be combined with a cover, thereby forming a receiving space for collecting cut paper chips.

3. The manually operated corner cutter in accordance with claim 2, wherein the base is formed with a collecting opening located beside the chopping board for introducing the cut paper chips into the receiving space between the base and the cover.

4. The manually operated corner cutter in accordance with claim 3, wherein the base is formed with multiple bolt holes located beside the collecting opening for locking the upright support post and the slide seat of the support and guide device.

5. The manually operated corner cutter in accordance with claim 1, wherein the upright support post and the slide seat of the support and guide device are integrally formed with each other.

6. The manually operated corner cutter in accordance with claim 1, wherein the slide seat has a height slightly smaller than that of the upright support post.

7. The manually operated corner cutter in accordance with claim 1, further comprising a front sealing plate secured on the two opposite lugs of the slide seat to seal a front side of the guide channel, and a lower sealing plate secured on the two opposite lugs of the slide seat to seal a bottom side of the guide channel, thereby forming a semi-sealed guide space, wherein the lower sealing plate is formed with a through hole for passage of the lower section of the blade post.

8. The manually operated corner cutter in accordance with claim 1, wherein the blade seat has a bottom longitudinally formed with a dovetail shaped insertion groove, and each of the multiple cutting tools has a top face provided with a dovetail shaped insertion block that may be inserted into the dovetail shaped insertion groove of the blade seat.

9. The manually operated corner cutter in accordance with claim 1, wherein the blade seat has one side formed with a bolt hole, each of the multiple cutting tools has one side formed with a bolt hole aligning with the bolt hole of the blade seat, and the manually operated corner cutter further comprises a bolt extended through the bolt hole of the blade seat, and screwed into the bolt hole of one of the multiple cutting tools, for combining the blade seat with one of the multiple cutting tools.

10. The manually operated corner cutter in accordance with claim 1, wherein the second end of each of the two opposite links of the press and control handle is formed with a bolt hole for passage of a bolt which is screwed into the upper end of the upright support post, so that the second end of each of the two opposite links of the press and control handle is pivotally mounted on the upper end of the upright support post.

11. The manually operated corner cutter in accordance with claim 1, wherein the intermediate portion of each of the two opposite links of the press and control handle is formed with a bolt hole for passage of a bolt which is screwed into the upper end of the blade post, so that the intermediate portion of each of the two opposite links of the press and control handle is pivotally mounted on the upper end of the blade post.

* * * * *